US007545706B2

(12) United States Patent
Candaux

(10) Patent No.: US 7,545,706 B2
(45) Date of Patent: Jun. 9, 2009

(54) DEVICE FOR FIXING AT LEAST ONE STRIKING GONG IN TIMEPIECE AND METHOD OF FIXING AT LEAST ONE STRIKING GONGS IN A TIMEPIECE

(75) Inventor: David Candaux, Le Brassus (CH)

(73) Assignee: Richemont International SA, Villars-sur-Glane (CH)

( * ) Notice: Subject to any disclaimer, the term of this patent is extended or adjusted under 35 U.S.C. 154(b) by 133 days.

(21) Appl. No.: 11/908,320

(22) PCT Filed: Feb. 7, 2006

(86) PCT No.: PCT/IB2006/000494

§ 371 (c)(1),
(2), (4) Date: Sep. 11, 2007

(87) PCT Pub. No.: WO2006/095244

PCT Pub. Date: Sep. 14, 2006

(65) Prior Publication Data

US 2008/0165630 A1 Jul. 10, 2008

(30) Foreign Application Priority Data

Mar. 11, 2005 (CH) ..... 0425/05

(51) Int. Cl.
*G04B 21/00* (2006.01)

(52) U.S. Cl. ..... 368/243; 368/267; 368/269

(58) Field of Classification Search ..... 368/72–73, 368/243, 244, 248, 257, 261, 267–271
See application file for complete search history.

(56) References Cited

U.S. PATENT DOCUMENTS

| | | | | |
|---|---|---|---|---|
| 3,869,855 | A * | 3/1975 | Sodler | 368/243 |
| 4,258,432 | A * | 3/1981 | Zafferri et al. | 368/250 |
| 4,271,498 | A * | 6/1981 | Zafferri et al. | 368/250 |
| 5,604,718 | A * | 2/1997 | Mignot et al. | 368/255 |

FOREIGN PATENT DOCUMENTS

| | | |
|---|---|---|
| CH | 375664 | 11/1963 |
| CH | 523527 | 1/1972 |

* cited by examiner

*Primary Examiner*—Vit W Miska
(74) *Attorney, Agent, or Firm*—Young & Thompson

(57) ABSTRACT

The device for mounting and fastening at least one gong of a striking mechanism of a watch movement in which each gong (1, 14) is solidly attached to a heel (2, 15) and includes means for the positioning and temporary fastening (5, 6, 8, 9, 20) of the heel or heels and their gongs to a bottom plate (7) of the watch movement. It includes at least one crystal support (21) fastened underneath the crystal (22) of a case holding the watch movement, and means for guiding and positioning (5, 6, 11) that allow the gongs (1, 14) and their heels (2, 15) to be moved into their working position where each heel is in touch with the crystal support (21) or with another heel. It further includes means for fastening (13) gongs and their heels to the crystal support (21) in such a way that these gongs and their heels are tied to the crystal (22).

17 Claims, 2 Drawing Sheets

DEVICE FOR FIXING AT LEAST ONE STRIKING GONG IN TIMEPIECE AND METHOD OF FIXING AT LEAST ONE STRIKING GONGS IN A TIMEPIECE

Objects of the present invention are a device for fastening at least one gong in a watch, and a method of fastening at least one gong in a watch. Equally an object of the invention is a watch including said fastening device.

The gong or gongs of a striking mechanism in a watch, as for instance a minute repeater, must be housed in the watch case, and generally are fastened to the movement's bottom plate for evident reasons of a facile assembly and setting or tuning. Yet this arrangement muffles or reduces the volume of the sound emitted, since the sound is not transmitted directly to an element of the watch case, and sound transmission between the gong, the bottom plate, and then a part of the case occurs under poor conditions.

It is known, on the other hand, that the transmission of sound waves between two parts in contact will depend on the material of which said parts are made. In practice, the gongs are made of spring steel, and for an effective transmission of their vibrations to their support, then to the bottom plate it will be necessary that the speed of sound in the material of the gongs be the same as, or inferior to, that in the material that forms their support. This is not always realised, as the bottom plate of the movement may be made of brass, which subtracts from the function of sound wave transmission.

It is the aim of the present invention to realise a fastening device for at least one watch gong that remedies the disadvantages cited above, that is, will yield a better transmission of sound to the air surrounding the watch. The invention also aims at a method of fastening one or several gongs in a watch.

The fastening device for at least one gong in a watch is distinguished by the characteristics listed in claim 1, while the fastening method comprises the operations listed in claim 10.

The invention also aims at a watch distinguished by the characteristics listed in claim 8.

The annexed drawing illustrates schematically and by way of example, one embodiment of the fastening device according to the invention.

Figure 1:
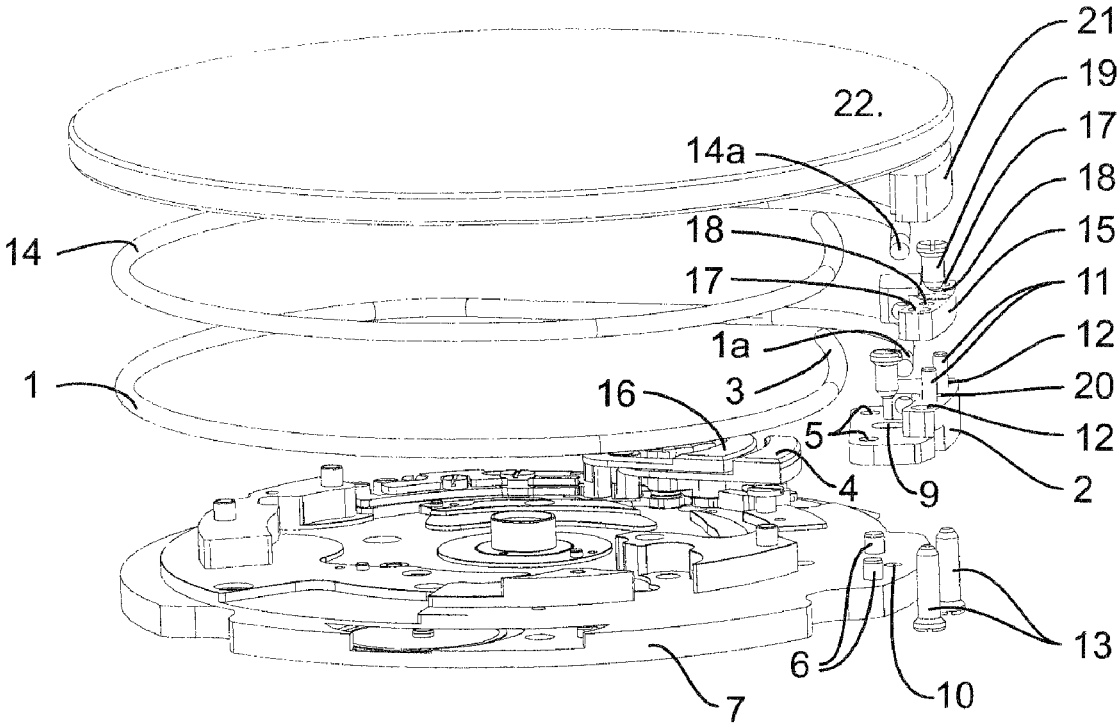
FIG. 1 is an exploded view illustrating the bottom plate of a watch movement, two gongs, and the crystal of the watch.
Figure 2:
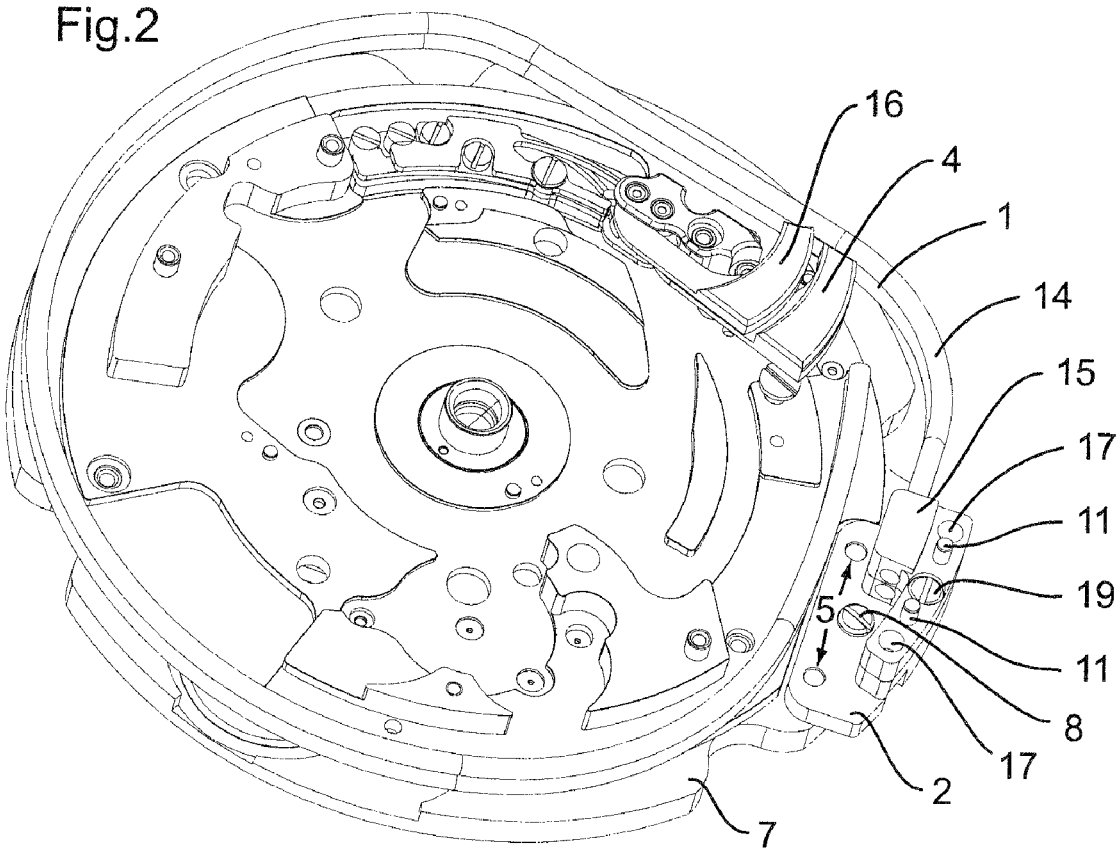
FIG. 2 illustrates the temporary fastening of the gongs to the bottom plate of the movement so that they may be tuned.
Figure 3:
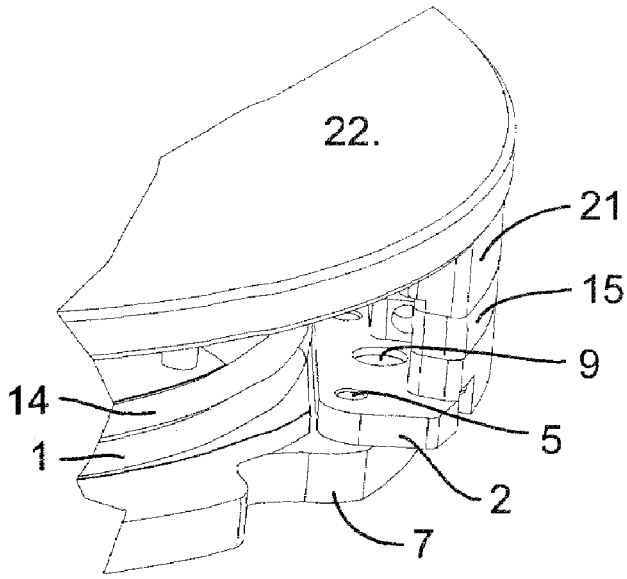
FIG. 3 is a partial view illustrating the release of the gongs from the bottom plate of the movement.
Figure 4:
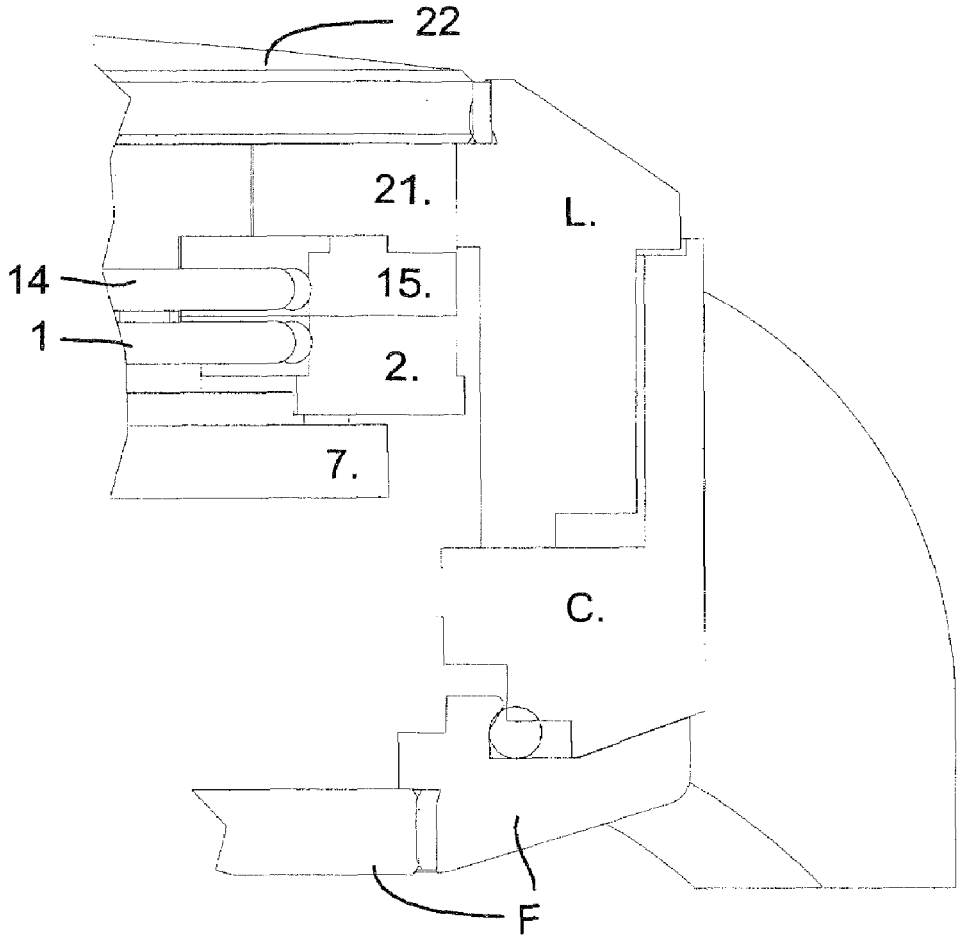
FIG. 4 illustrates the definitive fastening of the tuned gongs to the watch crystal, the watch case also being shown in this view.

The fastening device for one or several gongs of a watch is distinguished by said gong or gongs being fastened, not to the bottom plate of the movement but to an element of the watch case, and notably the watch crystal. In this way the sound waves generated by the vibrating gongs are directly transmitted to an outer element of the watch case, which favours and reinforces their transmission to the ambient air surrounding the watch. This reduces the energy losses and thus raises the sound volume and power perceived by the user. It will be seen in what follows that the gongs, moreover, are welded to heels the material of which can be identical with that of the gongs, said heels subsequently being fastened to a crystal support also made of a material, generally steel, that is identical or similar to that of the heels and gongs, yielding transmission of the waves without loss. The crystal support, finally, is solidly attached to the crystal, the crystal's material exhibiting a larger speed of sound than steel and favouring a good transmission of the waves or vibrations from this crystal support to the crystal itself.

However, a process for fixing or assembling said gongs also had to be developed, so that such a device for fastening the gongs to the crystal of a watch would become possible. It is not possible, in fact, to tune or adjust the frequency of the gongs while they are fastened to the crystal, since access to the hammers or gongs for a setting is no longer possible once the gongs are in place.

For this reason, this method for fastening the gongs comprises an intermediate step in which said gongs are temporarily fastened to the bottom plate of the watch movement so that they can be tuned and set. It is only after this tuning of the gongs that they are fastened to the crystal, as will be seen in what follows.

In the embodiment illustrated in the drawing, and described in what follows by way of example, we look at a watch provided with two gongs, one hour gong and one minute gong, cooperating with the corresponding hour and minute hammers that are part of the watch movement. It will be seen in what follows that these gongs are fastened to the watch crystal.

It is seen particularly well from FIG. 1 that the minute gong 1 is welded with one of its ends to a minute heel 2, and arranged so as to cooperate with a minute hammer 4 once the watch is finished. The minute heel 2 includes two guide bores 5 which, while the gongs are tuned, are intended to cooperate with two positioning pins 6 that are integral with bottom plate 7 of the movement. The minute heel also includes a bore 9 intended to cooperate with the cylindrical segment of a temporary fastening screw 8 the threaded end of which cooperates with a tapping 10 made in bottom plate 7, for the temporary fastening of minute heel 2 to bottom plate 7 while tuning the gongs.

The upper face of minute heel 2 includes two positioning pins 11. The minute heel finally also includes two fastening bores 12 for the passing through of two fastening screws 13.

The hour gong 14 is welded with one of its ends to an hour heel 15, and cooperates with an hour hammer 16 once the watch is assembled. The hour heel includes two fastening bores 17 and two bores 18 intended to receive the positioning pins 11 of the minute heel. With a screw 19 going through the hour heel 15 and screwing into a tapping 20 of the minute heel 2, the hour heel 15 and minute heel 12 can be screwed together. With these two heels 2, 15 assembled, the free ends of the positioning pins 11 rise above the upper side of the hour heel 15. With the minute heel 2 and hour heel 15 assembled, the fastening bores 9, 17 are aligned so that the fastening screws 13 may pass through.

The fastening device also includes a crystal support 21 welded under the crystal 22 of the watch. This support of crystal 21 includes two tappings (not illustrated) intended to cooperate with the fastening screws 13. This crystal support also includes two blind bores (not illustrated) intended to receive the free ends of the positioning pins 11 of the minute heel 2.

The minute heel 2 and hour heel 15 thus include means for positioning 11, 18 and for fastening 19, 20 so that they can be assembled and solidly fixed together.

The fastening screws 13, moreover, when passing through bores 9, 17 of the heels 2, 15 and screwing into the crystal support 21, enable the heels 2, 15 and their gongs 1, 14 to be solidly attached to crystal 22.

Mounting and fastening the minute gong 1 and hour gong 14 to the watch is done as follows.

The crystal support 21 is welded to crystal 22. Then the crystal is indexed and driven into its bezel L.

The end 1*a* of minute gong 1 is engaged into a corresponding bore of the minute heel 2, and these parts are welded together, for instance by laser welding.

The end 14*a* of hour gong 14 is engaged into a corresponding hole of the hour heel, and these parts are welded together, for instance by laser welding.

Preferably, gongs 1 and 14 are made of spring steel while heels 2 and 15 are made of steel as well, so that the speed of sound of the materials constituting the gongs and heels are identical, yielding an optimum transmission of the sound waves.

The hour heel 15 is fitted onto the positioning pins 11 of the minute heel 2, and these two heels 2, 15 are then fixed together with the aid of screw 19.

This assembly consisting of gongs 1, 14 and their heels 2, 15 is placed onto bottom plate 7 with the aid of pins 6 and screw 8 cooperating with tapping 10.

While this assembly is fastened to bottom plate 7 the gongs are set or tuned. This operation consists in adjusting the position of the hammers relative to that of the gongs, and in adjusting the frequency of these gongs, generally by taking off material so as to attain the desired tone.

This tuning or setting of the gongs is influenced by all shifts of the gongs in the plane of bottom plate 7 but is practically independent of any slight displacement perpendicularly to the plane of said plate 7.

Once finished with the tuning, one removes the temporary fastening screw 8 so as to separate the gongs and their heels from bottom plate 7 while maintaining their relative positions with the aid of the pins 6 engaged in the bores 5 of the minute heel 5.

One now mounts the dial, then the hands and fastens the movement of which plate 7 forms the upper side, to the middle C of the case.

The bezel L into which the crystal has already been indexed and driven is now indexed onto the middle C so that all bores of the crystal support 21 will be aligned with the pins 11 of the minute heel, then fastened to said middle C of the case, so that crystal 22 is fixed on the middle in its definitive position.

The watch is turned, and the fastening screws 13 are set into bores 9, 17 of the heels 2, 15, then screwed into the tappings provided for this purpose in the crystal support 21. The assembly of heels 2, 15 and gongs 1, 14 moves slightly toward crystal 22 while being guided by the pins 6 and pins 11, and is then rigidly fastened to the crystal support 21. At this point the pins 6 have withdrawn from the corresponding guide bores of the minute heel 2 so that gongs 1, 14 and their heels 2, 15 are now only in touch with crystal 22 via the crystal support 21.

The assembly of the watch is then finished off by fitting the back F of the case.

Thanks to this method of mounting and to this device for fastening, the gongs of a watch have for the first time been fastened directly to the watch glass. It should be noted that after assembly, bezel L of the watch may be in touch with the crystal support 21, which will also be favourable for sound transmission.

It should be noted to the contrary that assembled, the gongs and their heels are no longer in touch with bottom plate 7 nor with any other element of the movement.

The gongs thus are directly and exclusively tied to an outer element of the watch case, with the aid of a chain of elements favourable to a good conduction of the sound waves, so that unequaled sound qualities and volumes can be obtained.

It should also be remarked that in such an embodiment, the hammers 4, 16 of the striking mechanism are arranged on the upper side of the movement underneath the dial, rather than on the back side of the movement, as is general practice. The back side of the movement thus is free.

In the example illustrated, two gongs are described, but it is obvious that striking mechanisms with one gong or with more than two gongs may be realised following the same principle, so long as the fastening device for the gongs includes:

- means for fastening and positioning the heels and the gongs, on top of each other if there is more than one gong,
- means for temporary positioning and fastening of the gong or gongs to the bottom plate of the watch movement,
- means for guiding and fastening the heel or heels of the gongs during their movement from their temporary position fastened to the bottom plate, to their final, definitive position fastened to a support that is integral with the watch crystal.

A further object of the present invention is a watch including a striking mechanism that is distinguished by the fact that the gong or gongs are fastened via their heels to a support fastened underneath the watch crystal.

According to an alternative embodiment, several crystal supports 21 may be used, and each gong heel (and thus, indirectly, each gong) may he fastened to a different crystal support 21. According to yet another embodiment, the crystal support 21 may be longer and heels 2 and 15 may be arranged side by side (either touching each other or with space between them) so that both of the heels 2 and 15 would be directly fastened to the support 21.

A further object of the invention is a process of mounting and fastening of the gong or gongs of a watch that in a privileged embodiment comprises the following operations:

1. The gong or gongs are solidly attached as for instance by welding to a corresponding heel made of a material exhibiting the same speed of sound as, or a larger speed of sound than the material of which the gongs are made.
2. If there is more than one gong to the striking mechanism, the fastening in a specific working position where the heels of these gongs are one on top of the other.
3. The positioning of the set of gongs and their heels on the bottom plate and the temporary fastening of this assembly to said bottom plate of the watch movement.
4. The tuning or setting of the gongs.
5. The separation of the assembly of gongs and their heels from the bottom plate of the movement.
6. The fastening of the dial and hands to the watch movement.
7. The fastening of a crystal support underneath the watch crystal, notably by welding, while the material of this support exhibits a speed of sound equal to or higher than that of the material of which the heels of the gongs are made.
8. Placing the crystal of the watch case onto the bezel and middle of the watch case, in a position such that the crystal support is aligned above the heels of the gongs.
9. Moving the assembly of gongs and their heels toward the crystal, in such a way that this assembly, always in guided fashion, lifts away from the bottom plate and comes to rest against the crystal support, and to be positioned there in its definitive working position.
10. Fastening of the assembly of gongs and their supports on the crystal support.
11. Fitting and fastening the back of the watch case onto its middle.

The invention claimed is:

1. Device for mounting and fastening at least one gong of a striking mechanism of a watch movement, characterised in that each gong (1, 14) is solidly attached to a corresponding heel (2, 15); in that it includes means for a temporary positioning and fastening (5, 6, 8, 9, 10) of the heel or heels and their gongs on a bottom plate (7) of the watch movement; in that it includes at least one crystal support (21) fastened underneath the crystal (22) of a case enclosing the watch movement; in that it includes guiding and positioning means (5, 6, 11) allowing the gongs (1, 14) and their heels (2, 15) to be moved to their working position where each heel either is in touch with the crystal support (21) or with another heel; and means for fastening (13) of the gongs and their heels on the crystal support (21) in such a way that these gongs and their heels are tied to the crystal (22).

2. Device according to claim 1, characterised in that the striking mechanism includes several gongs each fixed to its heel.

3. Device according to claim 2, characterised in that it also includes means for positioning and fastening (11, 19) of the heels on top of each other.

4. Device according to claim 1, characterised in that the crystal support or supports (21) are welded onto the crystal (22).

5. Device according to claim 1, characterised in that each gong (1, 14) is welded to its heel (2, 15).

6. Device according to claim 1, characterised in that the heels of different gongs are fastened independently of each other to a crystal support.

7. Device according to claim 1, characterised in that the heels of different gongs are fixed one on top of the other to form an assembly, and in that this assembly is fastened to a single crystal support.

8. Device according to claim 2, characterised in that the crystal support or supports (21) are welded onto the crystal (22).

9. Device according to claim 3, characterised in that the crystal support or supports (21) are welded onto the crystal (22).

10. Device according to claim 2, characterised in that each gong (1, 14) is welded to its heel (2, 15).

11. Watch comprising a movement housed in a case including a middle, a crystal, and a back, this watch being provided with a striking mechanism, characterized in that this striking mechanism includes at least one gong solidly attached at one of its ends to a heel, the gong and the heel both being of a material in which the speed of sound is lower than that of the crystal, the assembly of the gong and the heel being fixed, once the watch has been fully assembled, only to the watch crystal and not to a plate or other part of the watch, so that the vibrations of the gong are transmitted directly to the crystal.

12. Watch according to claim 11, characterized in that the at least one gong is made of steel and the heel is also made of steel.

13. Watch according to claim 11, characterized in that the assembly of the gong and the heel is fixed to the crystal by way of a crystal support.

14. Watch according to claim 13, characterized in that the crystal support is also of a material in which the speed of sound is lower that that of the crystal.

15. Watch according to claim 14, characterized in that the crystal support is made of steel.

16. Watch according to claim 15, characerised in that the at least one gong is made of steel and the heel is also made of steel.

17. Process of mounting and fastening of at least one gong of a watch that comprises the following operations:

solidly attaching the at least one gong to a corresponding heel made of a material exhibiting a speed of sound at least as great as a material of which the at least one gong is made;

if there is more than one said gong to the striking mechanism, fastening in a specific working position of the heels of said gongs one on top of one another;

positioning the at least one gong and the heels on a bottom plate as an assembly and temporarily fastening said assembly to a bottom plate of a watch movement;

tuning or setting the at least one gong;

separating the assembly of the at least one gong and the heels from the bottom plate of the movement;

fastening a dial and hands to the watch movement;

fastening a crystal support underneath the watch crystal while the material of the support exhibits a speed of sound equal to or higher than a speed of sound of the material of which the heels of the at least one gong are made;

placing the crystal of the watch case onto the bezel and middle of the watch case, in a position such that the crystal support is aligned above the heels of the at least one gong;

moving the assembly of the at least one gong and their heels toward the crystal, in such a way that the assembly, always in guided fashion, lifts away from the bottom plate and comes to rest against the crystal support, and to be positioned there in its definitive working position;

fastening the assembly of the at least one gong and their heels on the crystal support; and fitting and fastening the back of the watch case onto a middle of the watch.

* * * * *